US012758890B2

(12) United States Patent
Lin et al.

(10) Patent No.: US 12,758,890 B2
(45) Date of Patent: Oct. 13, 2026

(54) BIONIC ANIMAL

(71) Applicant: Pioneer Material Precision Tech Co., Ltd., New Taipei City (TW)

(72) Inventors: Chia-Liang Lin, New Taipei City (TW); Hao-Cheng Yang, New Taipei City (TW)

(73) Assignee: Pioneer Material Precision Tech Co., Ltd., New Taipei City (TW)

( * ) Notice: Subject to any disclaimer, the term of this patent is extended or adjusted under 35 U.S.C. 154(b) by 150 days.

(21) Appl. No.: 19/011,650

(22) Filed: Jan. 7, 2025

(65) Prior Publication Data

US 2026/0158401 A1 Jun. 11, 2026

(30) Foreign Application Priority Data

Dec. 11, 2024 (CN) ..... 202411814503.2

(51) Int. Cl.
*A63H 11/00* (2006.01)
*A63H 13/02* (2006.01)

(52) U.S. Cl.
CPC ..... *A63H 11/00* (2013.01); *A63H 13/02* (2013.01); *A63H 2011/16* (2013.01)

(58) Field of Classification Search
CPC ..... A63H 11/00; A63H 13/02; A63H 2011/16
USPC ..... 446/330
See application file for complete search history.

(56) References Cited

U.S. PATENT DOCUMENTS 1,891,816 A * 12/1932 Hewitt ..... A63H 7/06 446/272
4,671,779 A * 6/1987 Kurosawa ..... A63H 31/00 446/457
6,503,123 B2 * 1/2003 Chung ..... A63H 31/00 446/330
6,537,130 B1 * 3/2003 Lee ..... A63H 3/04 446/485
6,773,327 B1 * 8/2004 Felice ..... A63H 13/02 446/330
7,033,241 B2 * 4/2006 Lee ..... A63H 17/004 446/470
10,695,684 B1 * 6/2020 Greenley ..... A63H 3/00
11,969,662 B2 * 4/2024 Ishibashi ..... A63H 11/20
(Continued)

FOREIGN PATENT DOCUMENTS

CN 107351937 A 11/2017
CN 118633540 A 9/2024
(Continued)

*Primary Examiner* — Joshua D Huson
(74) *Attorney, Agent, or Firm* — Winston Hsu

(57) ABSTRACT

A bionic animal includes a fore body, a hind body and a tail. The hind body is rotatably connected to the fore body. The tail is connected to the hind body. The tail includes an elastomer, a plurality of joint members and at least one driving wire. The plurality of joint members are disposed side by side on the elastomer. The at least one driving wire passes through the plurality of joint members and is connected to the fore body. When the hind body rotates with respect to the fore body, the at least one driving wire is pulled to drive the plurality of joint members to rotate with respect to each other, so as to drive the elastomer to elastically deform. After the at least one driving wire is released, the elastomer provides an elastic force to make the plurality of joint members return.

7 Claims, 12 Drawing Sheets

(56) References Cited

U.S. PATENT DOCUMENTS

| | | | | |
|---|---|---|---|---|
| 2001/0041497 | A1* | 11/2001 | Hornsby | A63H 30/04 446/368 |
| 2007/0254556 | A1* | 11/2007 | Whitaker | A63H 3/46 446/390 |
| 2010/0003889 | A1* | 1/2010 | Greenley | A63H 31/06 446/330 |
| 2010/0075570 | A1* | 3/2010 | Cameron | A63H 13/02 446/330 |
| 2010/0151767 | A1* | 6/2010 | Rehkemper | A63H 11/20 446/330 |
| 2010/0167624 | A1* | 7/2010 | Asai | A63H 3/46 446/376 |
| 2011/0003528 | A1* | 1/2011 | Lam | A63H 3/20 446/330 |
| 2013/0206488 | A1* | 8/2013 | Horinouchi | A63H 11/20 901/1 |

FOREIGN PATENT DOCUMENTS

| | | | |
|---|---|---|---|
| JP | 2023-181172 | A | 12/2023 |
| WO | 2020/105309 | A1 | 5/2020 |

* cited by examiner

BIONIC ANIMAL

BACKGROUND OF THE INVENTION

1. Field of the Invention

The invention relates to a bionic animal and, more particularly, to a bionic animal capable of enabling a tail to move naturally and reducing mechanical complexity of the tail.

2. Description of the Prior Art

With the advancement of technology, the types of existing bionic animals are becoming more and more diverse. In general, a tail of the bionic animal must be able to curl and swing left and right to make animal simulation more realistic. The tail of existing bionic animals is composed of complicated mechanisms, which are not only expensive to manufacture, but the movement of the tail is not flexible and natural enough.

SUMMARY OF THE INVENTION

The invention provides a bionic animal capable of enabling a tail to move naturally and reducing mechanical complexity of the tail, so as to solve the aforesaid problems.

According to an embodiment of the invention, a bionic animal comprises a fore body, a hind body and a tail. The hind body is rotatably connected to the fore body. The tail is connected to the hind body. The tail comprises an elastomer, a plurality of joint members and at least one driving wire. The plurality of joint members are disposed side by side on the elastomer. The at least one driving wire passes through the plurality of joint members and is connected to the fore body. When the hind body rotates with respect to the fore body, the at least one driving wire is pulled to drive the plurality of joint members to rotate with respect to each other, so as to drive the elastomer to elastically deform. After the at least one driving wire is released, the elastomer provides an elastic force to make the plurality of joint members return.

In an embodiment, the hind body comprises a first rotating member and a second rotating member. The first rotating member is rotatably connected to the fore body. The second rotating member is rotatably connected to the first rotating member. The tail is connected to the second rotating member.

In an embodiment, the first rotating member rotates with respect to the fore body around a first axis to drive the tail to curl; the second rotating member rotates with respect to the fore body around a second axis to drive the tail to swing left and right; and the first axis is perpendicular to the second axis.

In an embodiment, the fore body comprises a frame and a connecting member, the frame has an arc-shaped guiding portion, the connecting member has a guiding recess, and the arc-shaped guiding portion is disposed in the guiding recess. When the first rotating member rotates with respect to the fore body around the first axis, the connecting member slides along the arc-shaped guiding portion along with the first rotating member and the second rotating member.

In an embodiment, a number of the at least one driving wire is three, each of the plurality of joint members has three through holes, the three driving wires pass through the three through holes of each of the plurality of joint members, one of the three driving wires is connected to the frame to drive the tail to curl, and the other two of the three driving wires are connected to the connecting member to drive the tail to swing left and right.

In an embodiment, the elastomer has a plurality of positioning portions, each of the plurality of joint members has a portioning recess, and the positioning recess is sleeved on the positioning portion to position the joint member on the elastomer.

In an embodiment, a plurality of joints are formed between the plurality of joint members, the elastomer has a plurality of deformable rebound structures, and positions of the plurality of deformable rebound structures correspond to positions of the plurality of joints.

In an embodiment, each of the plurality of joint members has two inclined restraining surfaces, and the two inclined restraining surfaces restrain a left and right swing angle of the joint member.

In an embodiment, the bionic animal further comprises a plurality of shell members. Each of the plurality of shell members has an engaging portion, each of the plurality of joint members has an engaging recess, and the engaging portion engages with the engaging recess to fix the shell member on the joint member.

In an embodiment, the elastomer is integrally formed through 3D printing.

In an embodiment, a material of the elastomer is thermoplastic polyurethane.

As mentioned in the above, the invention utilizes the elastomer to fix and connect the joint members of the tail and utilizes the driving wire to drive the joint members to rotate with respect to each other, so as to drive the elastomer to elastically deform. After the driving wire is released, the elastomer can provide an elastic force to make the joint members return. The invention connects the driving wire to the fore body to drive the tail to curl and/or swing left and right through the rotation of the hind body with respect to the fore body. Accordingly, the tail can move synchronously with the body without the need for an additional motor to actuate, which not only reduces mechanical complexity of the tail, but also makes the movement of the tail more realistic and natural. Furthermore, the invention may dispose two inclined restraining surfaces on each of the joint members to restrain the left and right swing angle of the joint member. Accordingly, the invention can ensure that the joint members will not swing excessively, thereby improving the stability of the bionic animal when walking. Moreover, the elastomer may be integrally formed through 3D printing, such that the elastomer can be manufactured quickly and conveniently.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
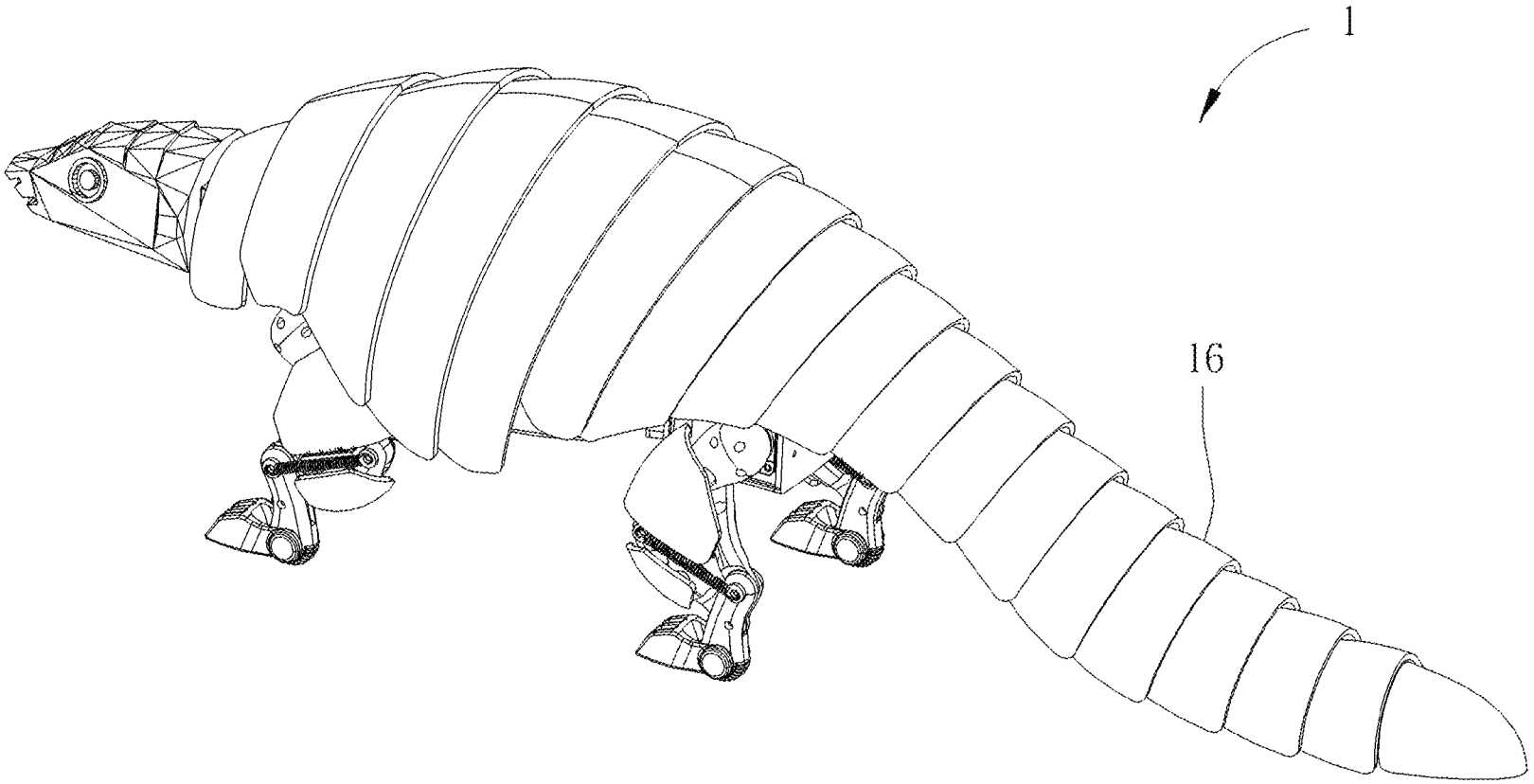
FIG. 1 is a perspective view illustrating a bionic animal according an embodiment of the invention.
Figure 2:
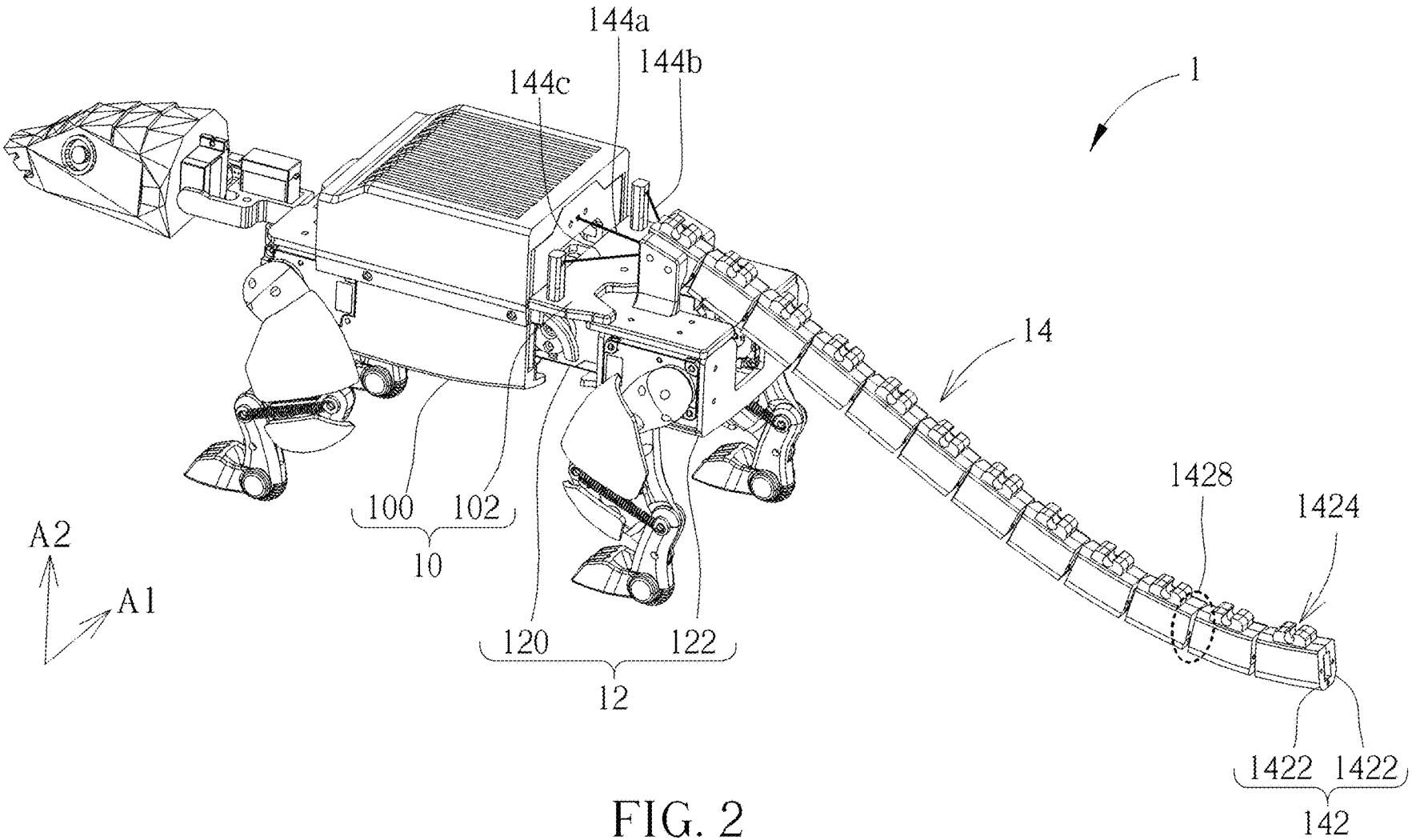
FIG. 2 is a perspective view illustrating the inside of the bionic animal.
Figure 3:
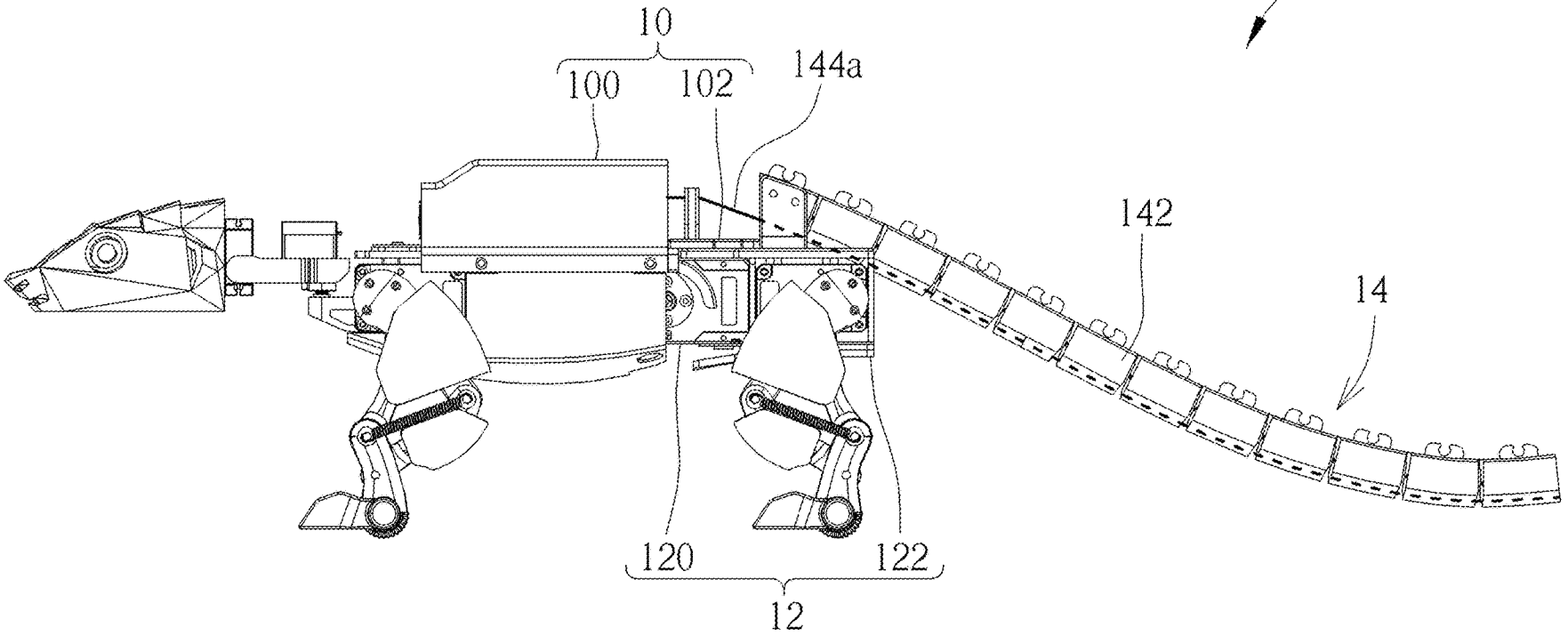
FIG. 3 is a side view illustrating a tail of the bionic animal before curling.
Figure 4:
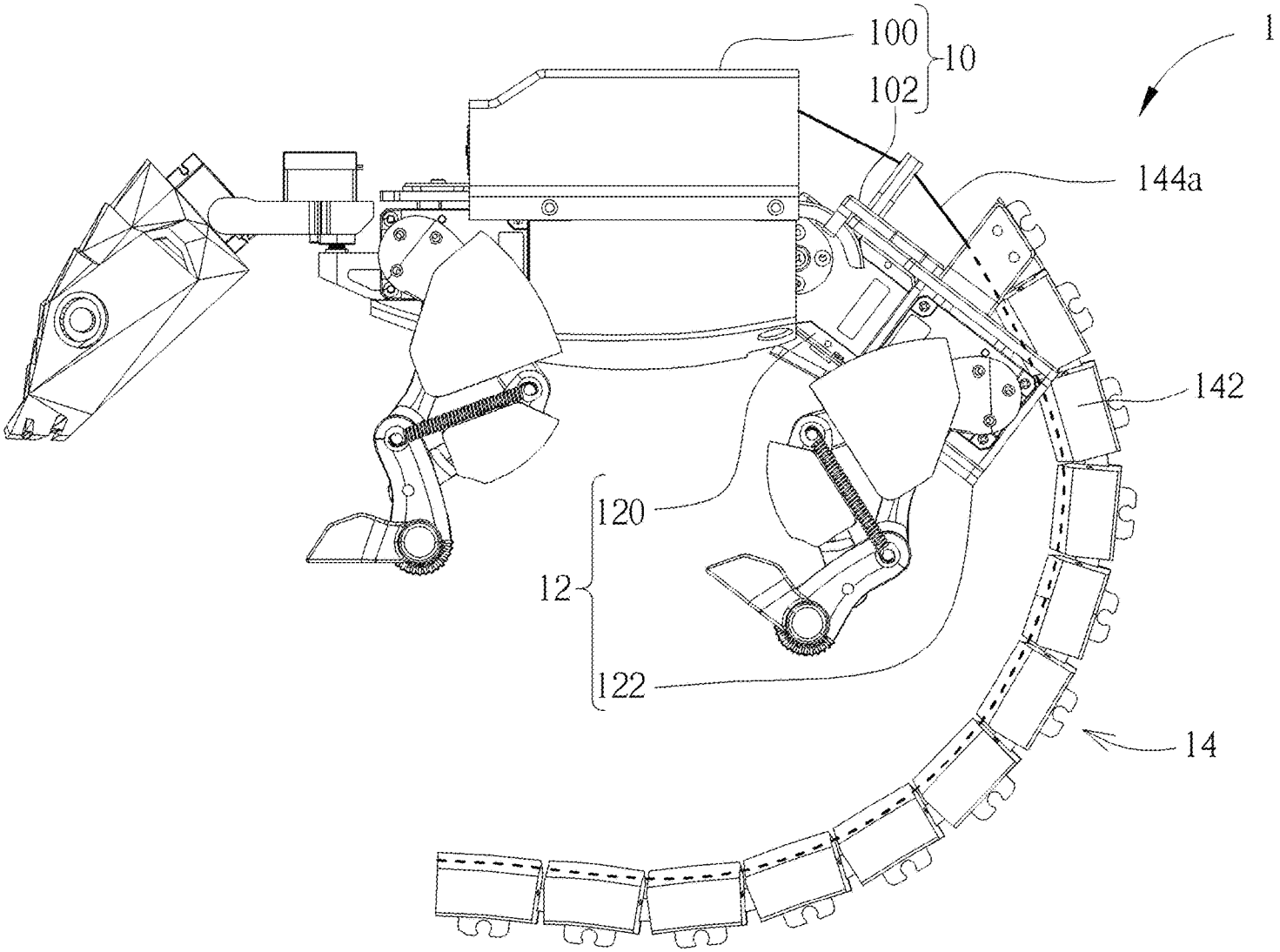
FIG. 4 is a side view illustrating the tail of the bionic animal after curling.
Figure 5:
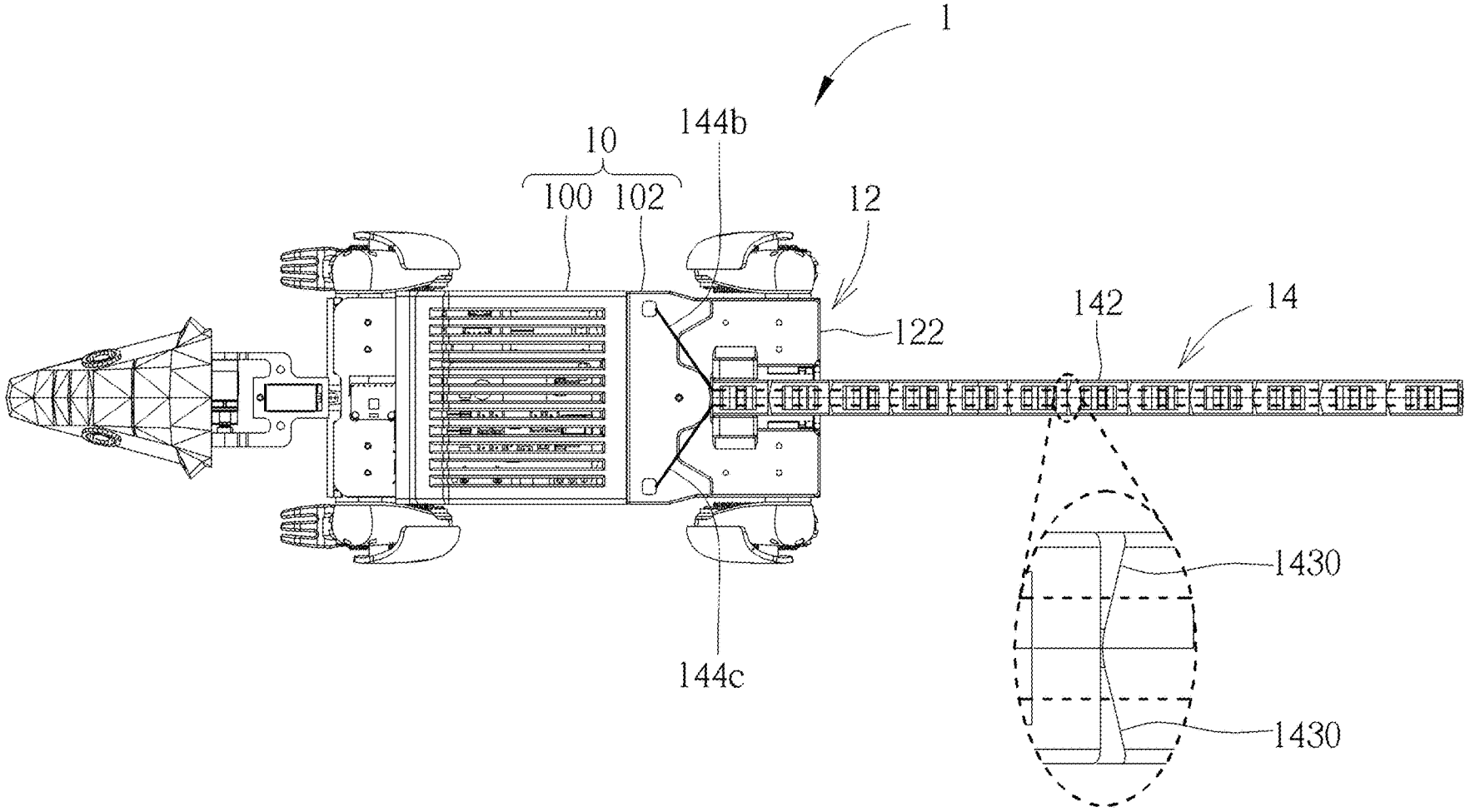
FIG. 5 is a side view illustrating the tail of the bionic animal before swinging.
Figure 6:
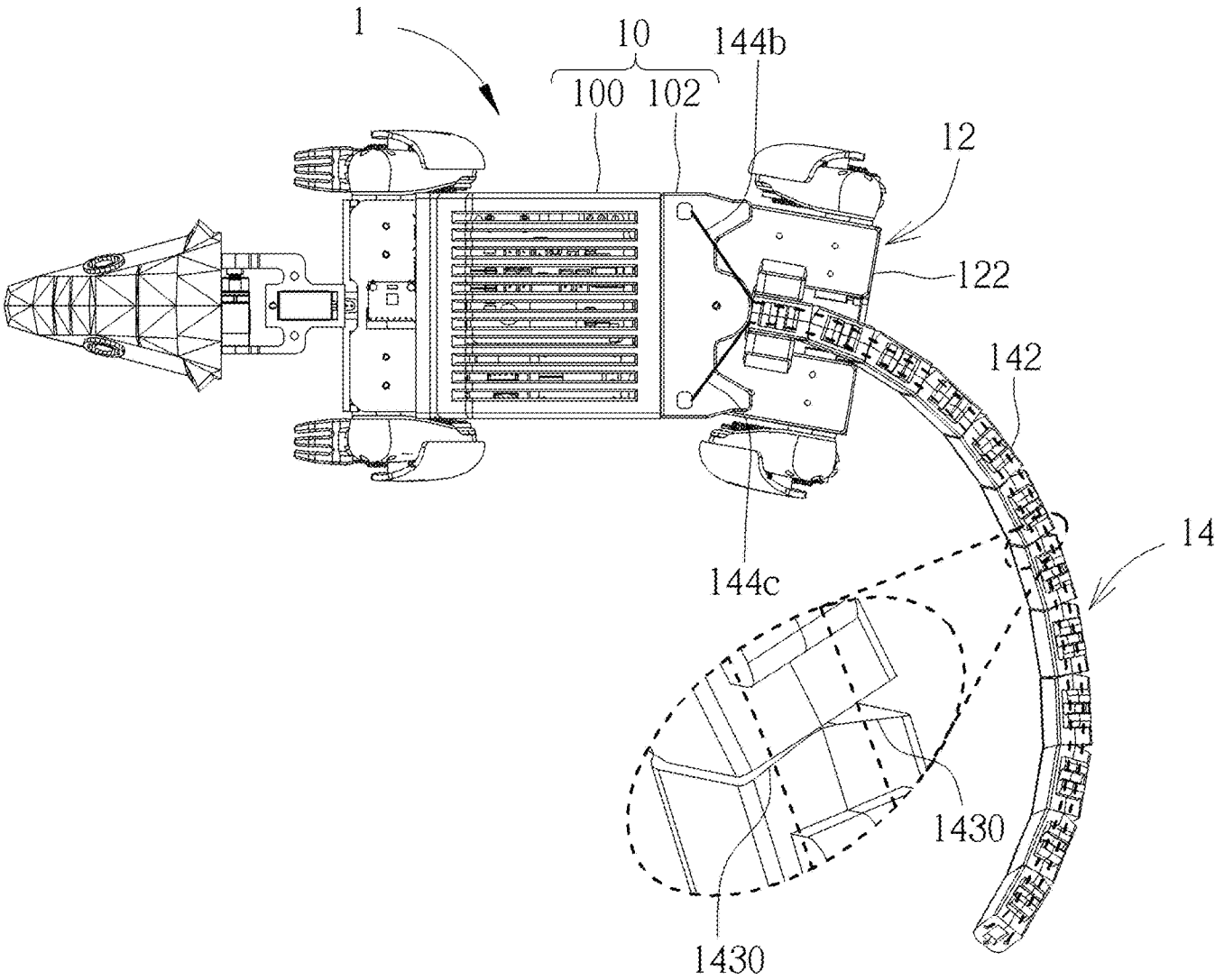
FIG. 6 is a side view illustrating the tail of the bionic animal after swinging left.
Figure 7:
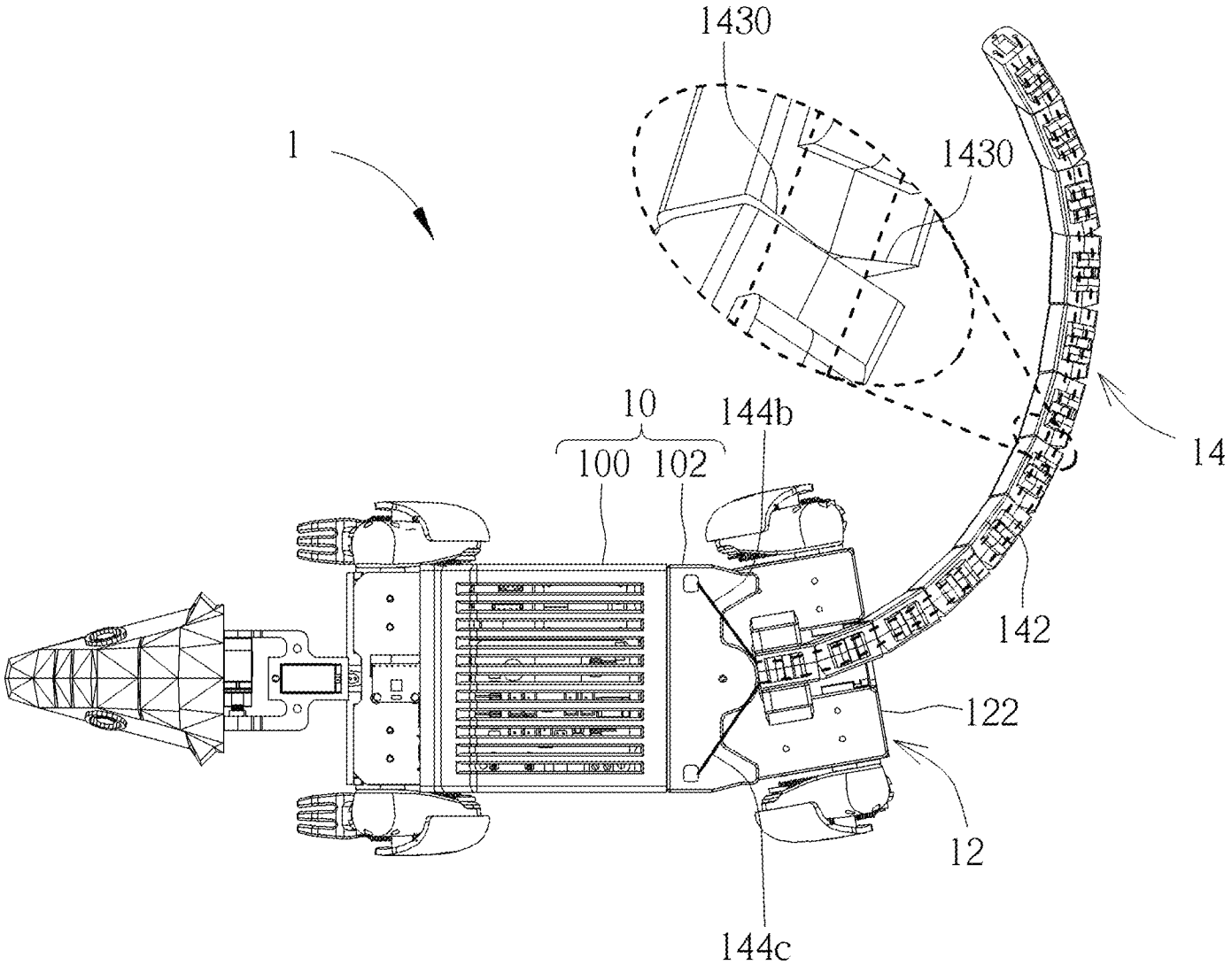
FIG. 7 is a side view illustrating the tail of the bionic animal after swinging right.
Figure 8:
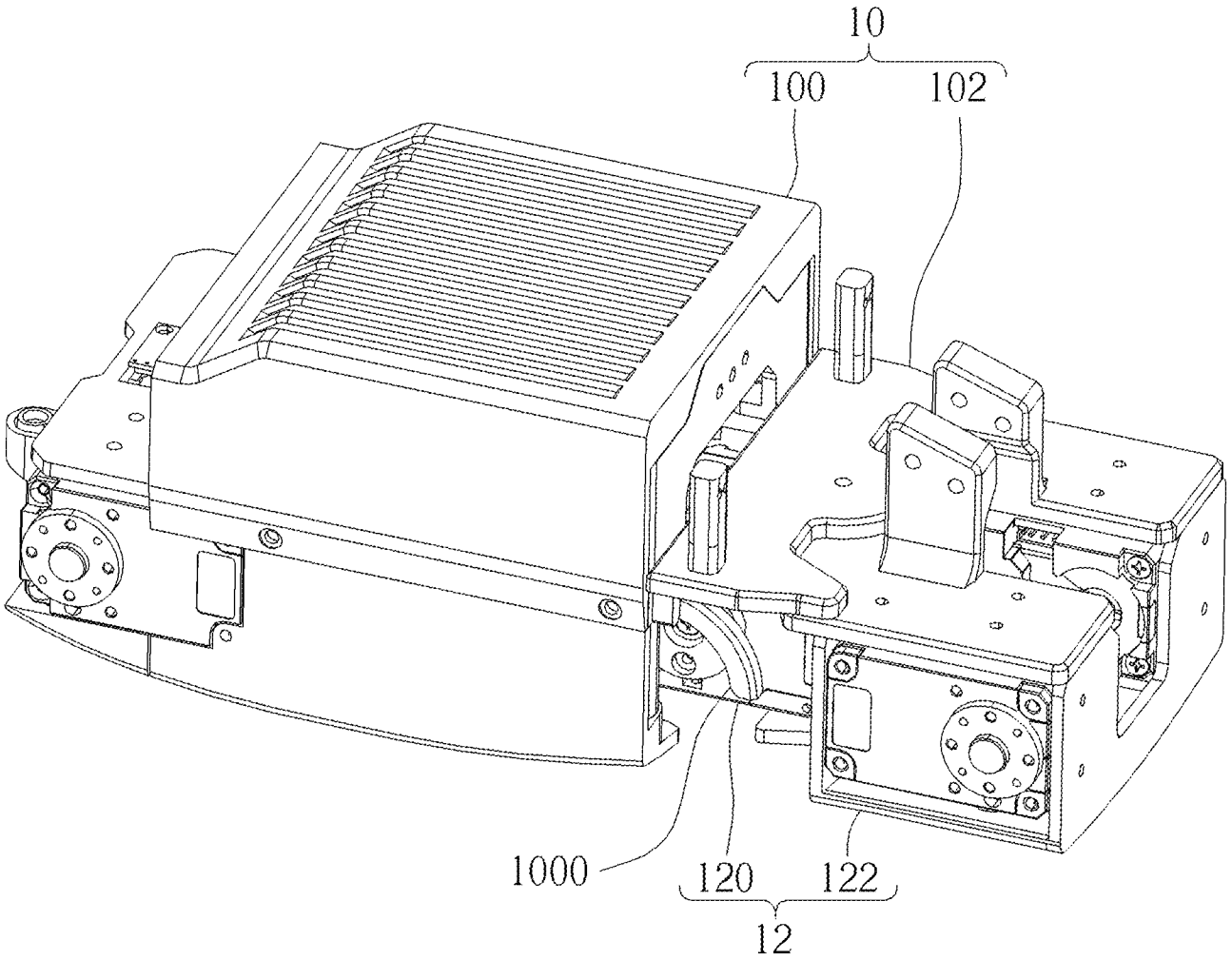
FIG. 8 is a perspective view illustrating a fore body and a hind body.
Figure 9:
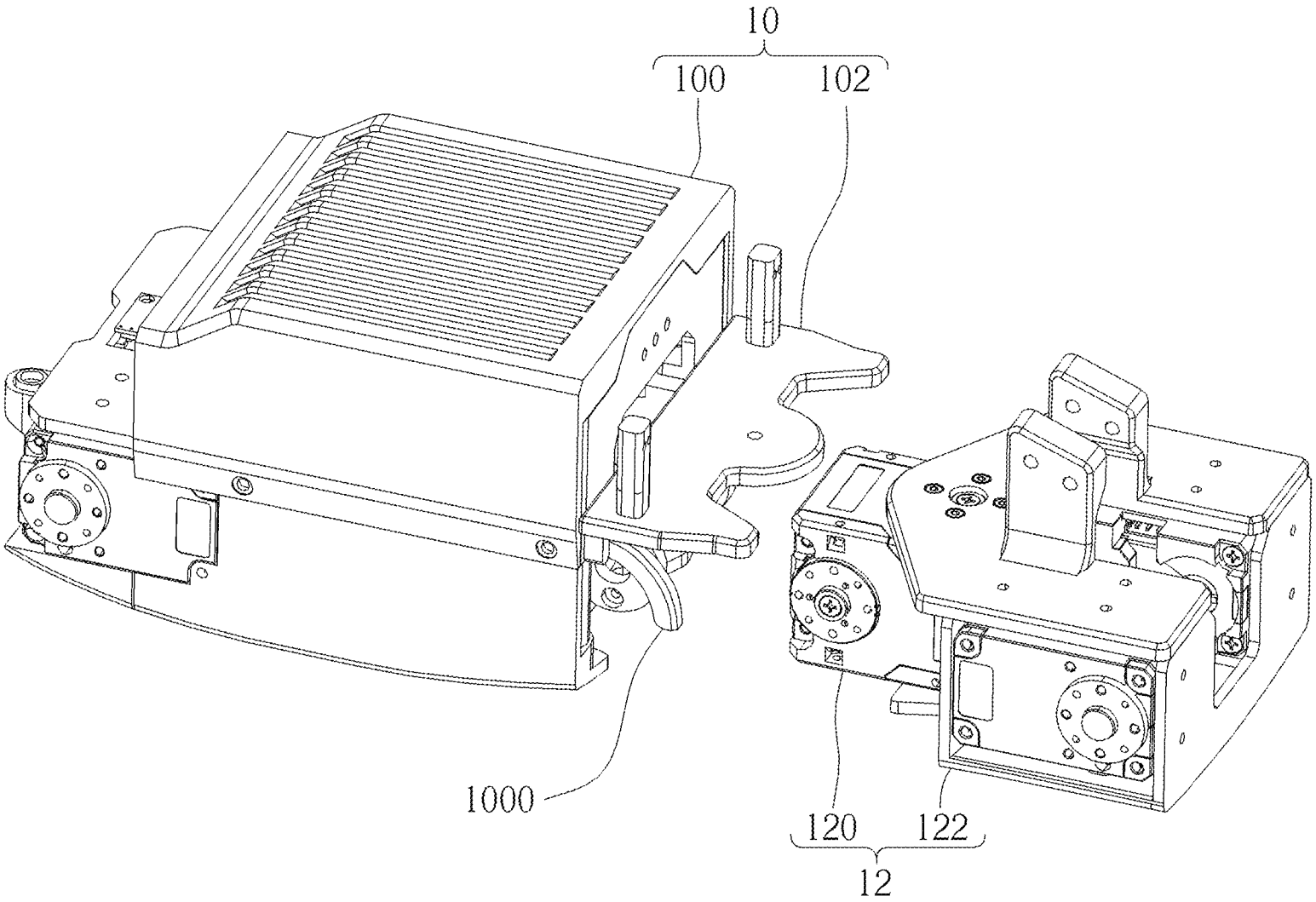
FIG. 9 is an exploded view illustrating the fore body and the hind body.
Figure 10:
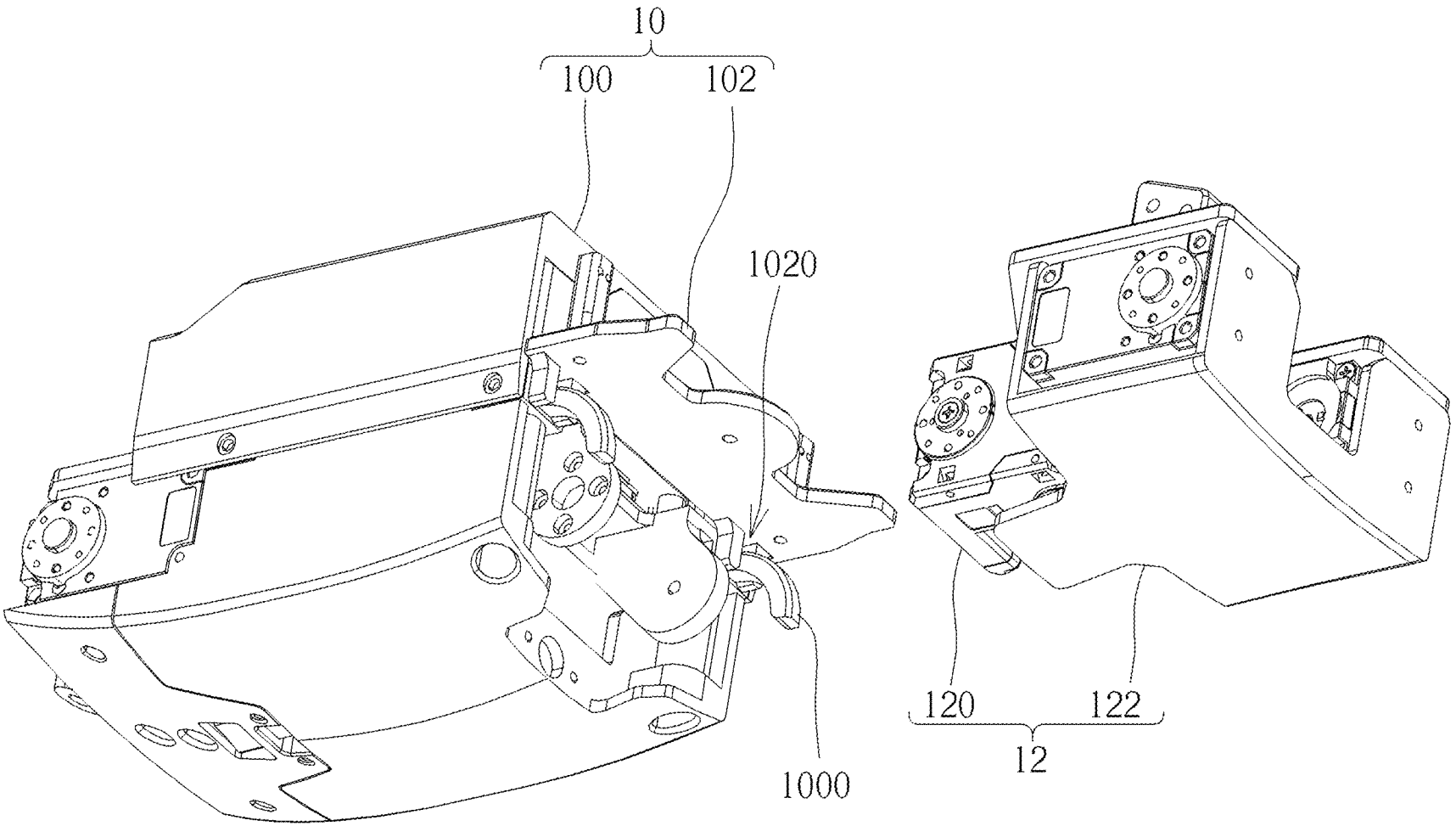
FIG. 10 is an exploded view illustrating the fore body and the hind body from another viewing angle.
Figure 11:
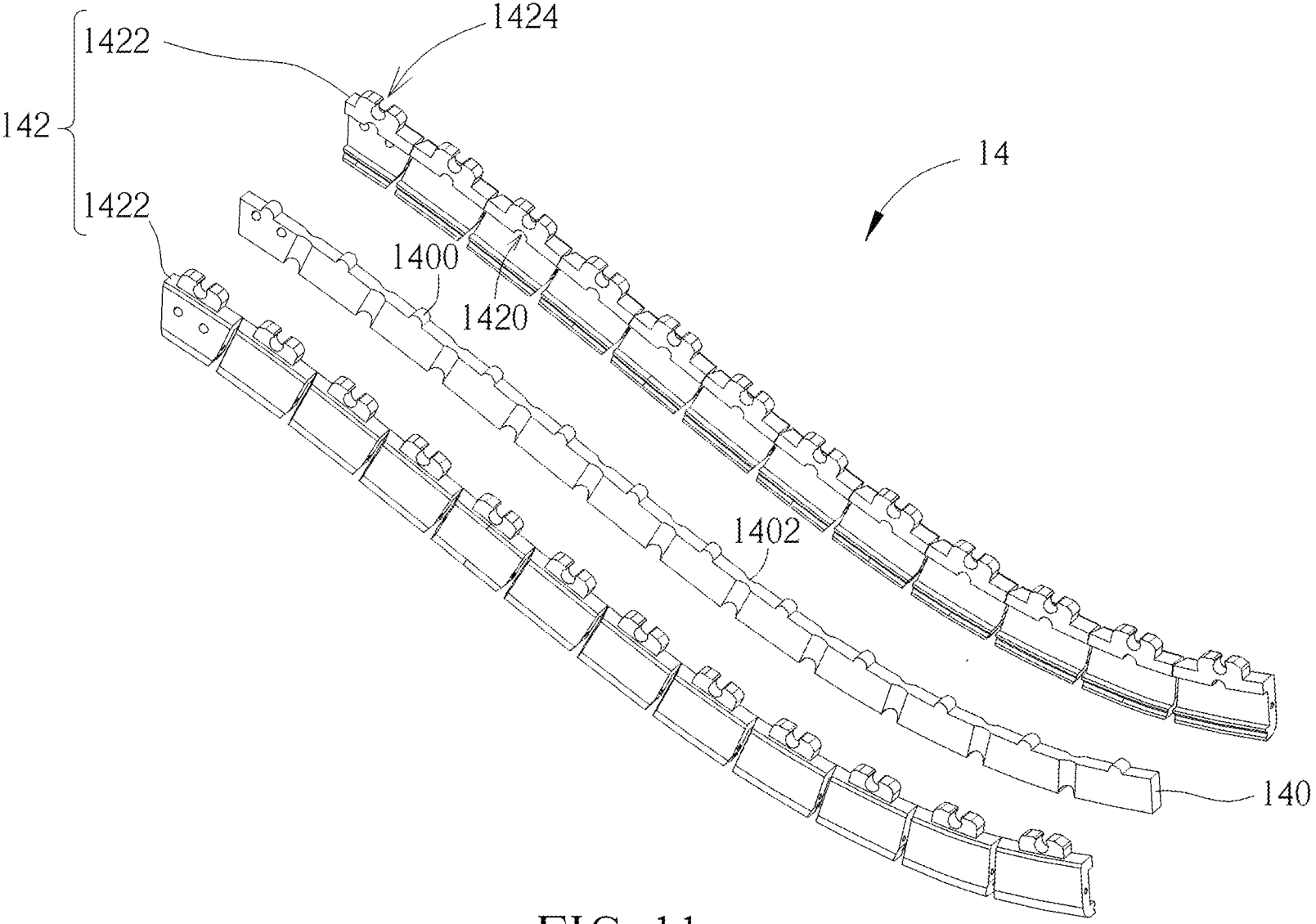
FIG. 11 is an exploded view illustrating the tail.
Figure 12:
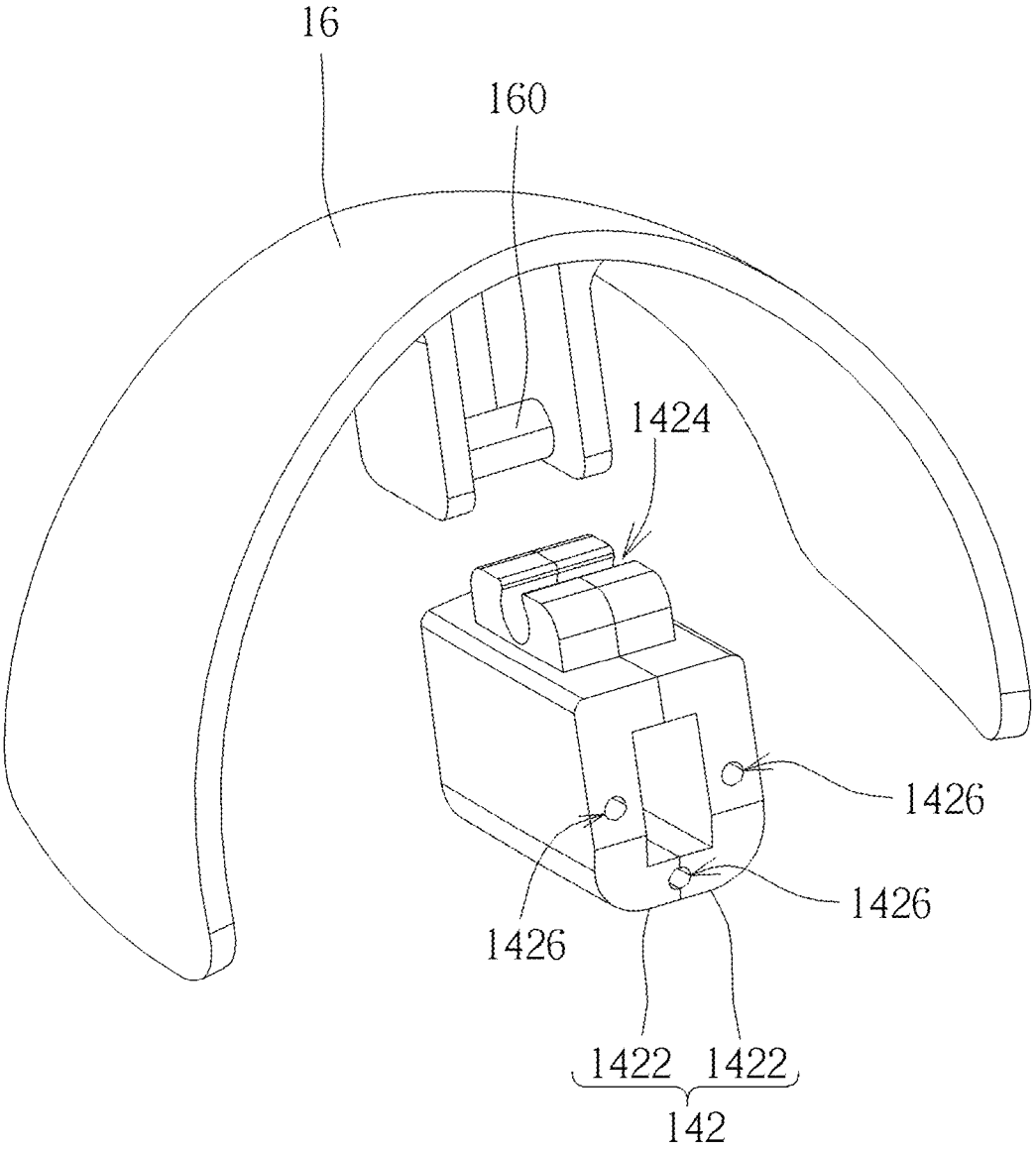
FIG. 12 is an exploded view illustrating a shell member and a joint member.

Referring to FIGS. 1 to 12, FIG. 1 is a perspective view illustrating a bionic animal 1 according an embodiment of the invention, FIG. 2 is a perspective view illustrating the inside of the bionic animal 1, FIG. 3 is a side view illustrating a tail 14 of the bionic animal 1 before curling, FIG. 4 is a side view illustrating the tail 14 of the bionic animal 1 after curling, FIG. 5 is a side view illustrating the tail 14 of the bionic animal 1 before swinging, FIG. 6 is a side view illustrating the tail 14 of the bionic animal 1 after swinging left, FIG. 7 is a side view illustrating the tail 14 of the bionic animal 1 after swinging right, FIG. 8 is a perspective view illustrating a fore body 10 and a hind body 12, FIG. 9 is an exploded view illustrating the fore body 10 and the hind body 12, FIG. 10 is an exploded view illustrating the fore body 10 and the hind body 12 from another viewing angle, FIG. 11 is an exploded view illustrating the tail 14, and FIG. 12 is an exploded view illustrating a shell member 16 and a joint member 142.

The bionic animal 1 of the invention may be, but is not limited to, a bionic pangolin. The type of the bionic animal 1 may be determined according to practical applications. As shown in FIGS. 1 and 2, the bionic animal 1 comprises a fore body 10, a hind body 12, a tail 14 and a plurality of shell members 16. The hind body 12 is rotatably connected to the fore body 10 and the tail 14 is connected to the hind body 12. When the hind body 12 rotates with respect to the fore body 10, the tail 14 will be driven to curl or swing left and right, as shown in FIGS. 3 to 7. The shell members 16 are disposed on the fore body 10, the hind body 12 and the tail 14 for decoration. In this embodiment, the shell members 16 may be in a shape of a carapace of a pangolin, but the invention is not so limited. In practical applications, the fore body 10 and the hind body 12 are configured to accommodate the main mechanical components and electronic components (e.g. motor, battery, circuit board, sensor, etc.) of the bionic animal 1.

As shown in FIGS. 8 to 10, the fore body 10 may comprise a frame 100 and a connecting member 102. The frame 100 has an arc-shaped guiding portion 1000 and the connecting member 102 has a guiding recess 1020. The arc-shaped guiding portion 1000 is disposed in the guiding recess 1020, such that the connecting member 102 can slide along the arc-shaped guiding portion 1000 with respect to the frame 100. In this embodiment, two sides of the frame 100 may have two arc-shaped guiding portions 1000 and two sides of the connecting member 102 may have two guiding recesses 1020. However, the invention is not so limited.

Furthermore, the hind body 12 may comprise a first rotating member 120 and a second rotating member 122. The first rotating member 120 is rotatably connected to the fore body 10, the second rotating member 122 is rotatably connected to the first rotating member 120, and the tail 14 is connected to the second rotating member 122. In this embodiment, the first rotating member 120 can rotate with respect to the fore body 10 around a first axis A1 to drive the tail 14 to curl, as shown in FIGS. 2 to 4. Still further, the second rotating member 122 can rotate with respect to the fore body 10 around a second axis A2 to drive the tail 14 to swing left and right, as shown in FIGS. 2 and 5 to 7. The first axis A1 is perpendicular to the second axis A2. In this embodiment, the first rotating member 120 is rotatably connected to the frame 100 of the fore body 10, and the second rotating member 122 is rotatably connected to the connecting member 102 of the fore body 10. Thus, when the first rotating member 120 rotates with respect to the fore body 10 around the first axis A1, the connecting member 102 will slide along the arc-shaped guiding portion 100 along with the first rotating member 120 and the second rotating member 122. Moreover, when the second rotating member 122 rotates with respect to the fore body 10 around the second axis A2, the connecting member 102 remains stationary.

As shown in FIGS. 2 to 7 and 11, the tail 14 comprises an elastomer 140, a plurality of joint members 142 and at least one driving wire 144*a*, 144*b*, 144*c*. The plurality of joint members 142 are disposed side by side on the elastomer 140. In this embodiment, the elastomer 140 may have a plurality of positioning portions 1400 and each of the joint members 142 may have a positioning recess 1420. The positioning recess 1420 is sleeved on the positioning portion 1400 to position the joint member 142 on the elastomer 140. In this embodiment, each of the joint members 142 may essentially consist of two fixing blocks 1422, such that the elastomer 140 is sandwiched between the two fixing blocks 1422 of each of the joint members 142. However, the invention is not so limited. Furthermore, as shown in FIG. 12, each of the shell members 16 may have an engaging portion 160 and each of the joint members 142 may have an engaging recess 1424. The engaging portion 160 engages with the engaging recess 1424 to fix the shell member 16 on the joint member 142.

As shown in FIGS. 3 to 7, the at least one driving wire 144*a*, 144*b*, 144*c* passes through the joint members 142 and is connected to the fore body 10. In this embodiment, a number of the at least one driving wire 144*a*, 144*b*, 144*c* may be three, i.e. the tail 14 comprises three driving wires 144*a*, 144*b*, 144*c*. As shown in FIG. 12, each of the joint members 142 may have three through holes 1426. The three driving wires 144*a*, 144*b*, 144*c* respectively pass through the three through holes 1426 of each of the joint members 142, wherein one of the three driving wires 144*a*, 144*b*, 144*c* is connected to the frame 100 of the fore body 10 to drive the tail 14 to curl, and the other two of the three driving wires 144*a*, 144*b*, 144*c* are connected to the connecting member 102 of the fore body 10 to drive the tail 14 to swing left and right. As shown in FIGS. 3 and 4, the driving wire 144*a* is connected to the frame 100 of the fore body 10 to drive the tail 14 to curl. As shown in FIGS. 5 to 7, the driving wires 144*b*, 144*c* are connected to the connecting member 102 of the fore body 10 to drive the tail 14 to swing left and right.

In this embodiment, a plurality of joints 1428 may be formed between the joint members 142 and the elastomer 140 may have a plurality of deformable rebound structures 1402, wherein the positions of the plurality of deformable rebound structures 1402 correspond to the positions of the plurality of joints 1428, as shown in FIGS. 2 and 11. When the hind body 12 rotates with respect to the fore body 10, the at least one driving wire 144*a*, 144*b*, 144*c* will be pulled to drive the plurality of joint members 142 to rotate with respect to each other, so as to drive the elastomer 140 to elastically deform. For further explanation, the at least one driving wire 144*a*, 144*b*, 144*c* drives the joint members 142 to rotate with respect to each other at the joints 1428, such that the deformable rebound structures 1402 at the joints 1428 elastically deform. After the at least one driving wire 144*a*, 144*b*, 144*c* is released, the elastomer 140 will provide an elastic force to make the plurality of joint members 142 return.

As shown in FIG. 4, when the first rotating member 120 of the hind body 12 rotates down with respect to the fore body 10, the driving wire 144*a* will be pulled to drive the tail 14 to curl. After the driving wire 144*a* is released, the elastomer 140 will provide an elastic force to make the plurality of joint members 142 return to the state shown in FIG. 3. Furthermore, as shown in FIGS. 6 and 7, when the second rotating member 122 of the hind body 12 rotates left and right with respect to the fore body 10, the driving wires 144*b*, 144*c* will be pulled to drive the tail 14 to swing left and right. After the driving wires 144*b* 144*c* are released, the elastomer 140 will provide an elastic force to make the plurality of joint members 142 return to the state shown in FIG. 5. Accordingly, the tail 14 can move synchronously with the hind body 12 without the need for an additional motor to actuate, which not only reduces mechanical complexity of the tail 14, but also makes the movement of the tail 14 more realistic and natural.

The invention may adjust the structural shape, structural density and/or material of the elastomer 140 according to practical requirements to control the elastic strength of the elastomer 140, so as to simulate the natural movement of the tails of different bionic animals. For example, in this embodiment, a material of the elastomer 140 may be thermoplastic polyurethane (e.g. TPU 95A) and the elastomer 140 may be integrally formed through 3D printing. TPU 95A is a semi-flexible material between rubber and plastic, which has high chemical resistance and is suitable for industrial applications. TPU 95A has excellent interlayer bonding force and can significantly improve structural stability. Compared with other TPU materials, TPU 95A is easier to print and has faster printing speed, such that it is very suitable for rapid manufacturing of mechanical structures.

In this embodiment, each of the joint members 142 may have two inclined restraining surfaces 1430. As shown in FIGS. 5 to 7, the two inclined restraining surfaces 1430 are configured to restrain a left and right swing angle of the joint member 142, so as to ensure that the tail 14 will not bend excessively.

As mentioned in the above, the invention utilizes the elastomer to fix and connect the joint members of the tail and utilizes the driving wire to drive the joint members to rotate with respect to each other, so as to drive the elastomer to elastically deform. After the driving wire is released, the elastomer can provide an elastic force to make the joint members return. The invention connects the driving wire to the fore body to drive the tail to curl and/or swing left and right through the rotation of the hind body with respect to the fore body. Accordingly, the tail can move synchronously with the body without the need for an additional motor to actuate, which not only reduces mechanical complexity of the tail, but also makes the movement of the tail more realistic and natural. Furthermore, the invention may dispose two inclined restraining surfaces on each of the joint members to restrain the left and right swing angle of the joint member. Accordingly, the invention can ensure that the joint members will not swing excessively, thereby improving the stability of the bionic animal when walking. Moreover, the elastomer may be integrally formed through 3D printing, such that the elastomer can be manufactured quickly and conveniently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bionic animal comprising:

a fore body;

a hind body rotatably connected to the fore body; and a tail connected to the hind body, the tail comprising:

an elastomer;

a plurality of joint members disposed side by side on the elastomer; and at least one driving wire passing through the plurality of joint members and connected to the fore body;

wherein, when the hind body rotates with respect to the fore body, the at least one driving wire is pulled to drive the plurality of joint members to rotate with respect to each other, so as to drive the elastomer to elastically deform; after the at least one driving wire is released, the elastomer provides an elastic force to make the plurality of joint members return;

wherein the hind body comprises a first rotating member rotatably connected to the fore body; and a second rotating member rotatably connected to the first rotating member, the tail being connected to the second rotating member;

wherein the first rotating member rotates with respect to the fore body around a first axis to drive the tail to curl; the second rotating member rotates with respect to the fore body around a second axis to drive the tail to swing left and right; and the first axis is perpendicular to the second axis;

wherein the fore body comprises a frame and a connecting member, the frame has an arc-shaped guiding portion, the connecting member has a guiding recess, and the arc-shaped guiding portion is disposed in the guiding recess; wherein, when the first rotating memberrotates with respect to the fore body around the first axis, the connecting member slides along the arc-shaped guiding portion along with the first rotating member and the second rotating member;

wherein a number of the at least one driving wire is three, each of the plurality of joint members has three through holes, the three driving wires pass through the three through holes of each of the plurality of joint members, one of the three driving wires is connected to the frame to drive the tail to curl, and the othertwo of the three driving wires are connected to the connecting member to drive the tail to swing left and right.

2. The bionic animal of claim 1, wherein the elastomer has a plurality of positioning portions, each of the plurality of joint members has a portioning recess, and the positioning recess is sleeved on the positioning portion to position the joint member on the elastomer.

3. The bionic animal of claim 1, wherein a plurality of joints are formed between the plurality of joint members, the elastomer has a plurality of deformable rebound structures, and positions of the plurality of deformable rebound structures correspond to positions of the plurality of joints.

4. The bionic animal of claim 1, wherein each of the plurality of joint members has two inclined restraining surfaces, and the two inclined restraining surfaces restrain a left and right swing angle of the joint member.

5. The bionic animal of claim 1, further comprising a plurality of shell members, wherein each of the plurality of shell members has an engaging portion, each of the plurality of joint members has an engaging recess, and the engaging portion engages with the engaging recess to fix the shell member on the joint member.

6. The bionic animal of claim 1, wherein the elastomer is integrally formed through 3D printing.

7. The bionic animal of claim 1, wherein a material of the elastomer is thermoplastic polyurethane.

* * * * *